US009631375B1

(12) United States Patent
Barlow

(10) Patent No.: US 9,631,375 B1
(45) Date of Patent: Apr. 25, 2017

(54) SHOCK ABSORBING INTERLOCKING FLOOR SYSTEM

(71) Applicant: 308, LLC, St. Petersburg, FL (US)

(72) Inventor: David R. Barlow, Seminole, FL (US)

(73) Assignee: 308, LLC, St. Petersburg, FL (US)

( * ) Notice: Subject to any disclaimer, the term of this patent is extended or adjusted under 35 U.S.C. 154(b) by 0 days.

(21) Appl. No.: 15/206,570

(22) Filed: Jul. 11, 2016

(51) Int. Cl.
*E01C 5/20* (2006.01)
*E04F 15/18* (2006.01)
*E04F 15/22* (2006.01)

(52) U.S. Cl.
CPC ..... *E04F 15/187* (2013.01); *E04F 15/225* (2013.01); *E04F 2201/0107* (2013.01); *E04F 2201/091* (2013.01); *E04F 2201/095* (2013.01)

(58) Field of Classification Search
CPC ..... E01C 2201/12; E01C 13/045; E01C 5/20; E04F 15/02194
USPC ..... 52/177, 385, 403.1
See application file for complete search history.

(56) References Cited

U.S. PATENT DOCUMENTS

| | | | | |
|---|---|---|---|---|
| 609,940 | A | 8/1898 | Koehler | |
| 841,490 | A | 1/1907 | Du Montier | |
| 1,920,920 | A | 8/1933 | Venzie | |
| 2,851,134 | A | 9/1958 | Robinson, Jr. | |
| 3,077,426 | A | 2/1963 | Johnston | |
| 3,735,988 | A | 5/1973 | Palmer et al. | |
| 4,590,726 | A | 5/1986 | Salazar | |
| 5,163,424 | A | 11/1992 | Kohnke | |
| 5,259,758 | A * | 11/1993 | Lauersdorf | F27B 9/32 110/336 |
| 6,082,886 | A | 7/2000 | Stanford | |
| 6,343,451 | B1 * | 2/2002 | Chih | B32B 3/30 52/312 |
| 6,453,632 | B1 * | 9/2002 | Huang | E04F 15/04 52/385 |
| 6,647,690 | B1 | 11/2003 | Martensson | |
| 6,793,586 | B2 | 9/2004 | Barlow et al. | |
| D499,189 | S | 11/2004 | Collison | |
| 6,862,857 | B2 | 3/2005 | Tychsen | |
| 6,922,965 | B2 | 8/2005 | Rosenthal et al. | |
| 6,968,663 | B2 | 11/2005 | Thiers et al. | |
| 7,003,924 | B2 | 2/2006 | Kettler et al. | |
| D530,835 | S | 10/2006 | Rosine et al. | |
| 7,287,357 | B2 | 10/2007 | Gomez Insa | |
| 7,299,592 | B2 | 11/2007 | Moiler, Jr. | |
| 7,340,865 | B2 | 3/2008 | Vanderhoef | |
| 7,487,622 | B2 * | 2/2009 | Wang | E04F 13/0862 52/177 |
| 7,516,587 | B2 | 4/2009 | Barlow | |

(Continued)

*Primary Examiner* — Rodney Mintz
*Assistant Examiner* — Daniel Kenny
(74) *Attorney, Agent, or Firm* — Larson & Larson, P.A.; Frank Liebenow; Patrick Reid

(57) ABSTRACT

Interlocking panels have a top portion and side edges. Multiple panels are interlocked together mechanically along the side edges by locking features. The top portion includes a substantially planar top surface, side edges, and interlocking features. The bottom support structure is made of a shock absorption material that fits under the substantially planar top surface, thereby providing support and cushioning to the substantially planar top surface. The locking features include, for example, alternating upward/downward facing steps or key/key receivers to hold adjacent interlocking panels to each other.

20 Claims, 17 Drawing Sheets

(56) References Cited

U.S. PATENT DOCUMENTS

| | | | | |
|---|---|---|---|---|
| 7,698,859 | B2 * | 4/2010 | Sansano Marti | E04F 15/02183 52/177 |
| 7,757,449 | B2 | 7/2010 | Portoles Ibanez et al. | |
| 7,930,865 | B2 * | 4/2011 | Barlow | B44C 1/28 404/41 |
| 8,353,640 | B2 | 1/2013 | Sawyer | |
| 8,397,456 | B2 * | 3/2013 | Ruhdorfer | B32B 27/10 156/308.2 |
| 8,662,787 | B2 | 3/2014 | Sawyer et al. | |
| 8,668,403 | B2 | 3/2014 | Sawyer | |
| 8,827,590 | B2 | 9/2014 | Sawyer et al. | |
| 8,967,905 | B2 | 3/2015 | Sawyer et al. | |
| 8,967,906 | B2 | 3/2015 | Sawyer | |
| 2002/0083673 | A1 | 7/2002 | Kettler et al. | |
| 2002/0189176 | A1 | 12/2002 | Stegner et al. | |
| 2003/0009971 | A1 | 1/2003 | Palmberg | |
| 2005/0016098 | A1 | 1/2005 | Hahn | |
| 2005/0028475 | A1 | 2/2005 | Barlow et al. | |
| 2005/0066606 | A1 | 3/2005 | Dolinski | |
| 2006/0070314 | A1 | 4/2006 | Jenkins et al. | |
| 2006/0272252 | A1 | 12/2006 | Moiler, Jr. | |
| 2006/0283127 | A1 | 12/2006 | Pervan | |
| 2007/0163195 | A1 | 7/2007 | Jenkins et al. | |
| 2007/0214741 | A1 | 9/2007 | Llorens Miravet | |
| 2007/0289236 | A1 | 12/2007 | Choi | |
| 2008/0010928 | A1 | 1/2008 | Moriau et al. | |
| 2008/0092473 | A1 | 4/2008 | Heyns | |
| 2008/0127593 | A1 | 6/2008 | Janesky | |
| 2008/0168730 | A1 | 7/2008 | Pervan et al. | |
| 2008/0168736 | A1 | 7/2008 | Pervan | |
| 2015/0176225 | A1 | 6/2015 | Sawyer | |
| 2015/0267357 | A1 | 9/2015 | Sawyer et al. | |

* cited by examiner

SHOCK ABSORBING INTERLOCKING FLOOR SYSTEM

FIELD OF THE INVENTION

The present invention relates to flooring and floor base systems. More particularly, it refers to multi-sectional interlocking panels designed to form a floor surface or under laying surface.

BACKGROUND OF THE INVENTION

Surface coverings, such as synthetic grass, carpet, linoleum, wood flooring, rubberized flooring system, and tile, need to be laid over a base that will support the surface covering. Commonly, surface coverings are laid over a base of compacted stone, asphalt, plywood, or cement. These base materials are expensive to install, and, once installed, are difficult to remove. Recreational surfaces frequently need to be moved to different locations because the same site is often used for different activities, such as an ice rink converted to a basketball court or concert stage. A need exists for an inexpensive, permanent or easily movable base surface or stand-alone floor surface that provides structural support while also providing adequate fall-height protection for athletes, animals, children, etc.

U.S. Pat. No. 7,516,587 to Barlow describes an "Interlocking Floor System," and is hereby incorporated by reference. This application describes polymeric panels that can be assembled into a floor system. Such panels are described as having an internal grid system beneath the surface for maintaining structure under the weight of people and objects.

Prior panels were either molded of a plastic material with a support structure (e.g. a grid) beneath the panels to provide rigidity or were formed entirely of foam or rubber; the latter were often used to cover sports fields, playgrounds, etc. Often the foam or rubber panels were made of polypropylene foam, polyethylene foam, or rubber, to help absorb the shock of a being impacting the surface.

What is needed is an interlocking panel that has the rigidity of plastic panels and the shock absorbing properties of foam or rubber panels.

SUMMARY OF THE INVENTION

This application describes interlocking panels attachable by locking features to create an indoor/outdoor floor system or floor system base. The interlocking panels are prepared by compression, blow, injection, or any other molding process to prepare a planar top surface. A shock absorption material is then attached to form a support structure beneath the planar top surface, providing a top planar surface that has a selectable amount of rigidity to provide structural support, while resilient by way of the resiliency of the shock absorption material, thereby providing proper fall/impact protection. Interlock features mounted at sides of each interlocking panel provide for connecting to adjacent interlocking panels, forming a large surface area. The interlocked panels are easily assembled and later disassembled if needed.

In one embodiment, interlocking panels for a floor system base are disclosed. The panels include a top portion that has a substantially planar top surface and has side surfaces. The top portion has features for interlocking with other interlocking panels; the features for interlocking are located on at least one of the side surfaces. The interlocking panels have bottom support structures filling an underside of the top portion, thereby providing support and shock absorption to the planar top surface.

In another embodiment, an interlocking panel for a floor system base is disclosed including a top portion that has a substantially planar top surface and side surfaces. The top portion has features for interlocking to other panels on at least one of the side surfaces. The interlocking panel has a bottom support structure comprised of a shock absorption material that provides support and shock absorption to the substantially planar top surface.

In another embodiment, an interlocking panel for a floor system base is disclosed including a top portion made or molded from one or more materials selected from polypropylene, structural urethane foams, polyolefin, filled plastic, phenolic, stiff rubber, and aluminum. The top portion has a substantially planar top surface and side surfaces; at least one of the side surfaces has a device for interlocking with other panels. A bottom support structure is made of a shock absorption material selected from, for example, polypropylene foam, expanded polypropylene foam, polyethylene foam, expanded polyethylene foam, polystyrene foam, expanded polystyrene foam, urethane foam, rubber, and processed recycled rubber. The bottom support structure provides support and shock absorption to the substantially planar top surface.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
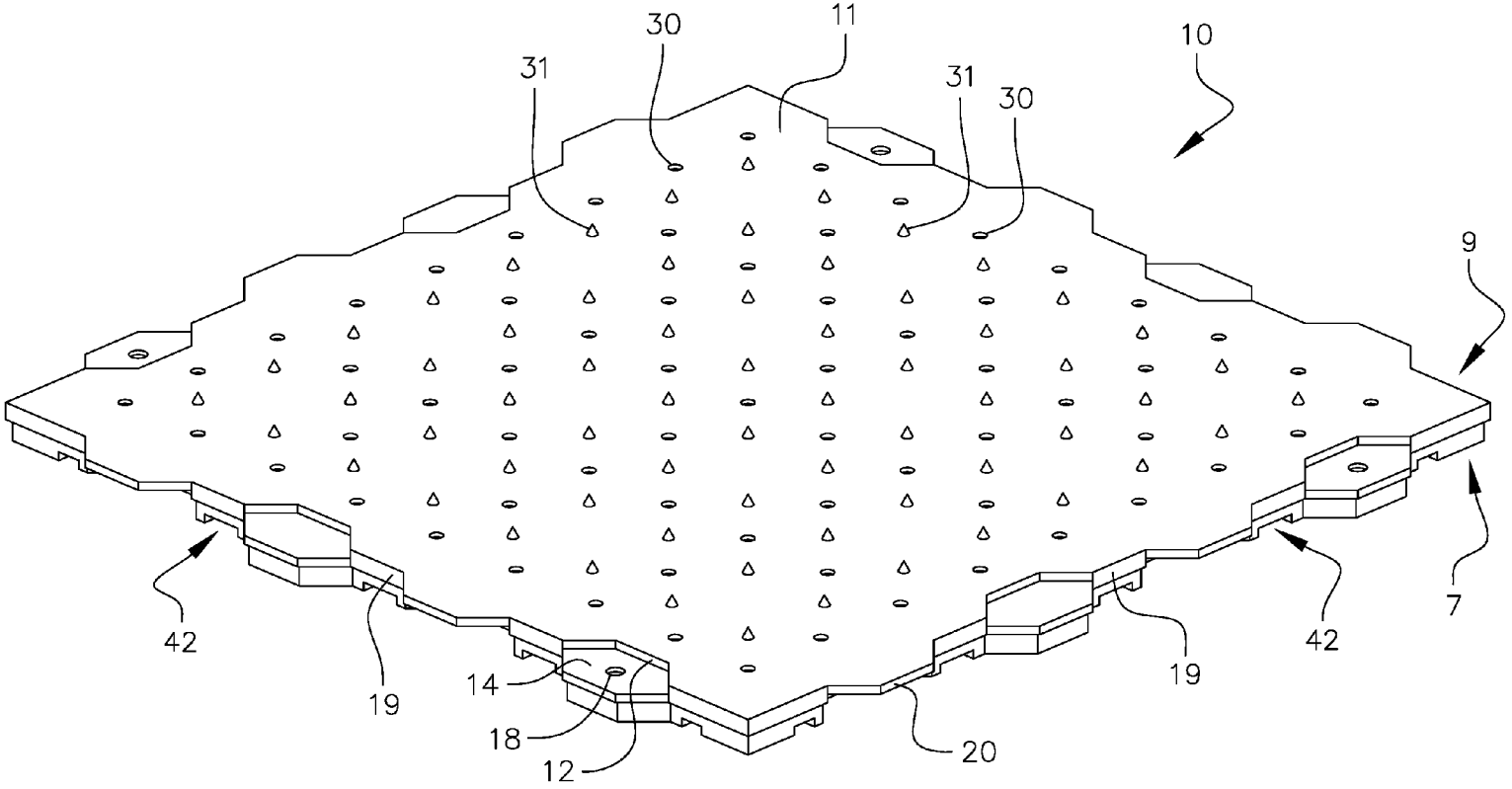
FIG. 1 illustrates a top isometric assembled top planar surface and the bottom support structure.

Reference will now be made in detail to the presently preferred embodiments of the invention, examples of which are illustrated in the accompanying drawings. Throughout the following detailed description, the same reference numerals refer to the same elements in all figures.

Throughout this description, the covering material is shown as an example, as it is fully anticipated that the panels have no covering material or any covering material, including, but not limited to carpet, linoleum, vinyl, wood, synthetic wood, ceramic tile, plastic tile, artificial turf, synthetic grass, etc. In some embodiments, the covering material is or includes organic material such as grass, sod, plants, etc.

Throughout the description, it is described that the top surface of the panels are made or molded from plastic, rubber, or stamped metal (e.g. aluminum). Although there is no limitation to the type of plastic, metal, rubber, and/or polymers that are anticipated, examples include, but are not limited to, polypropylene, structural urethane foams other suitable commercially available polyolefin, filled plastic, phenolic, stiff rubber, aluminum, etc.

Throughout the description, it is described that the bottom support structure of the interlocking panels are made from a shock absorbing material. Although there is no limitation to the type of shock absorbing material, example shock absorption materials include, but are not limited to, polypropylene foam, expanded polypropylene foam, expanded polyethylene foam, polyethylene foam, expanded polystyrene foam, expanded urethane foam and/or rubber such as processed recycled rubber.

Although one method of manufacturing the interlocking panels is by molding the top section and molding the bottom section, then joining the top section and the bottom section, any method of manufacturing is anticipated, including, but not limited to molding both the top and bottom sections at one time, stamping the top section from sheet metal, die cutting, etc.

Figure 2:
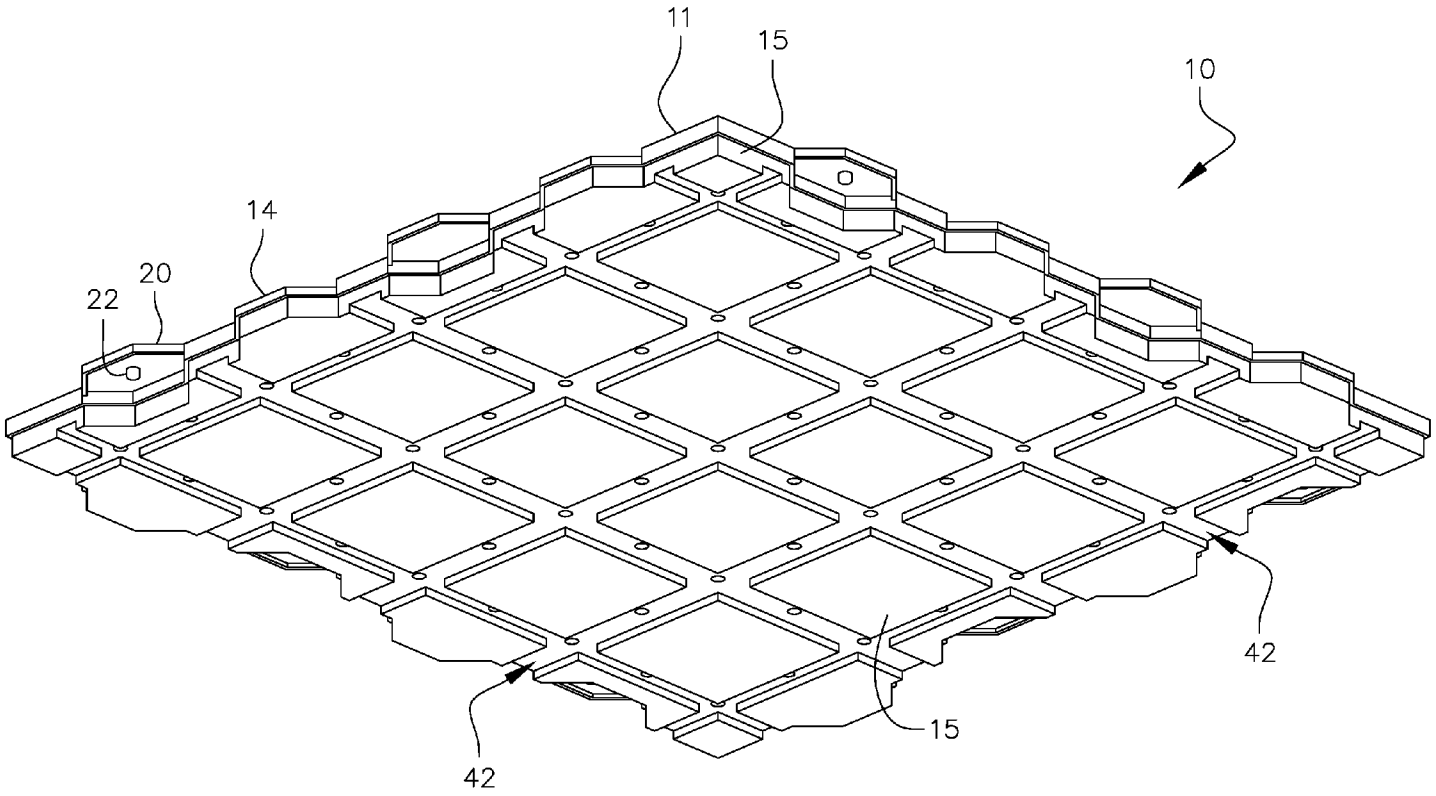
FIG. 2 illustrates a bottom isometric assembled top planar surface and the bottom support structure.

Referring to FIGS. 1 and 2, interlocking panels 10 are shown. Each interlocking panel 10 includes a substantially planar top portion 9, having a planar top surface 11. The planar top surface 11, side surfaces 19, and interlock mechanisms 12/14/18/20/22 are rigid to semi-rigid (e.g. bends slightly under force). The top portion 9 includes planar top surface 11, side surfaces 19, and interlocking features 12/14/18/20. In some embodiments, the top portion is molded from a plastic material (see above), providing the rigid or semi-rigid substantially planar top surface 11.

Supporting the planar top surface 11 is a bottom support structure 7 bonded/held thereto, having a bottom 15. The bottom support structure 7 is made of a shock absorption material that provides support and resiliency to the top surface 11. Although any resilient shock absorption material is anticipated, in some embodiments, the shock absorption material is polypropylene foam, expanded polypropylene foam, polyethylene foam, polystyrene foam, urethane foam and/or rubber such as processed recycled rubber. In one example, foam from used mattresses is used.

In some embodiments, the planar top surface 11 includes projections 31 such as pointy projections as shown for reducing sideways movement of a covering material 60 (see FIGS. 6 and 7) such as artificial turf, carpet, etc.

In some embodiments, one or more drainage holes 30 are provided in the top surface 11 for drainage. Liquids (e.g. rain, water, etc.) that fall on the surface 11, drain through the drainage holes 30. Some of this liquid percolates down into the sub-surface, while in some embodiments, troughs 42 are formed in the bottom support structure 7. In such, it is preferred that the drainage holes 30 are fluidly interfaced to the troughs 42. As it will be shown, the troughs 42 of one interlocking panel 10 are preferably fluidly interfaced with troughs 42 of adjacent interlocking panels 10, permitting the flow of the fluids between interlocking panels 10.

Although many panel interlock mechanisms are anticipated, the interlock mechanism of FIGS. 1 and 2 include upward facing steps 14 and downward facing steps 20. In one embodiment, at least one of the downward facing steps 20 contains a downwardly pointing projection 22 (e.g., convex projection) on a downwardly facing surface as shown in FIG. 2. In such embodiments, at least one of the upward facing steps 14 contains a mating depression 18 (e.g. dimple) on an upwardly facing surface. It is fully anticipated that, alternately, the projection 22 be on the step 14 and the mating depression 18 be on the downward facing step 20.

Also, in such embodiments, it is anticipated that the depression 18 is larger than the projection 22 to provide for a small amount of lateral movement to provide for expansion and contraction as temperatures vary.

Figure 3:
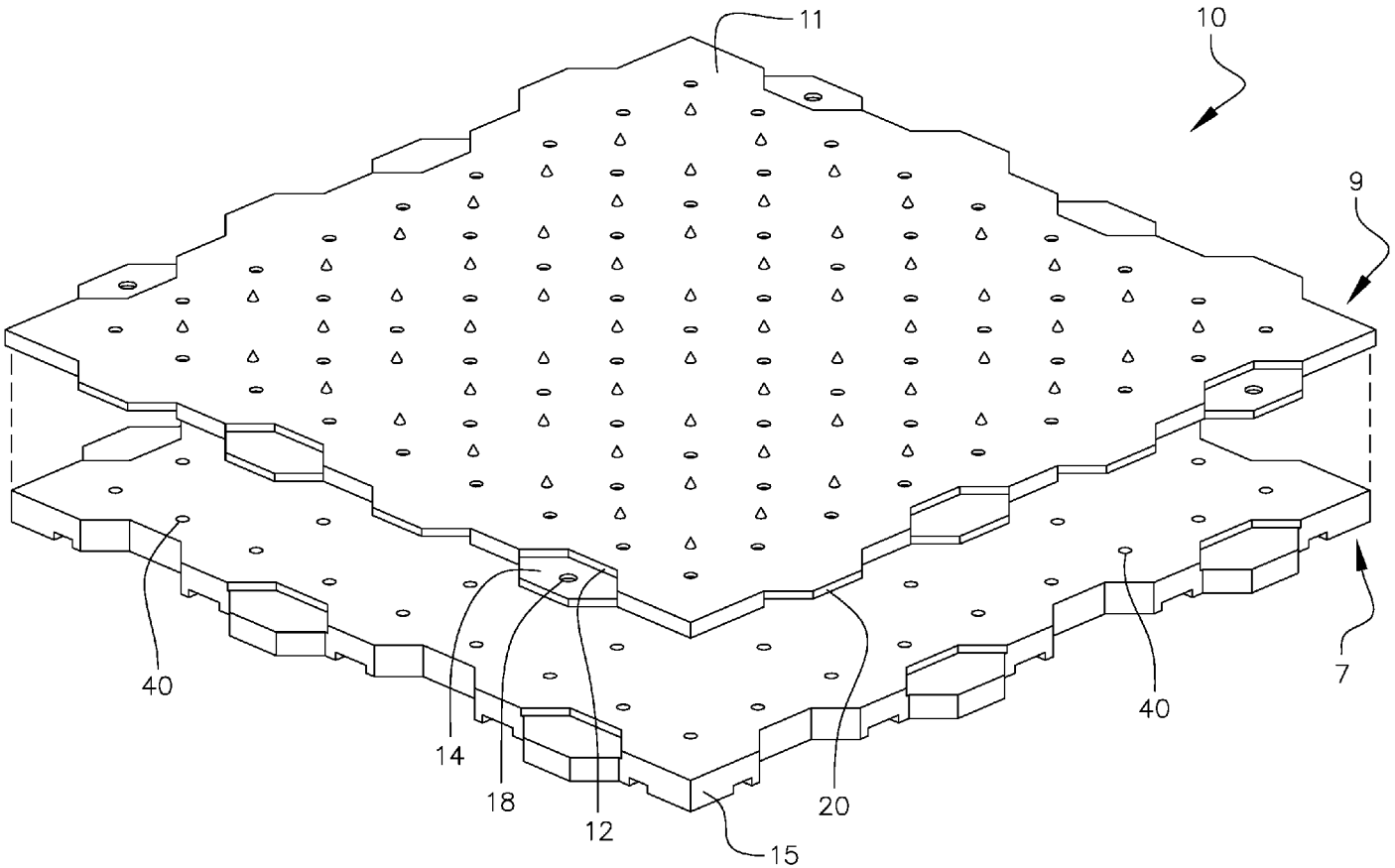
FIG. 3 illustrates a top isometric exploded top planar surface and the bottom support structure.
Figure 4:
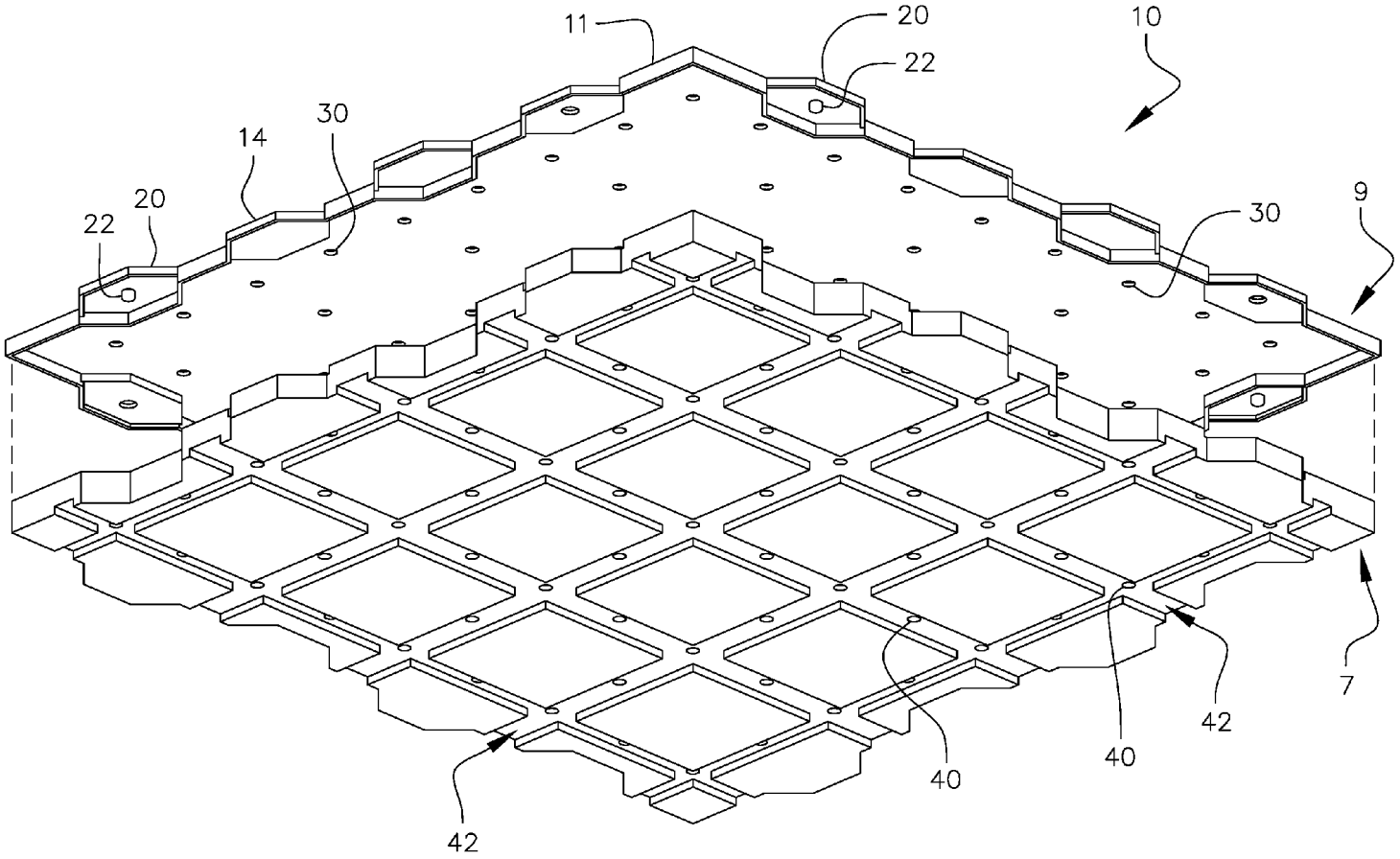
FIG. 4 illustrates a bottom isometric exploded top planar surface and the bottom support structure.

Referring to FIGS. 3 and 4, top and bottom isometric exploded views of the top portion 9 and the bottom support structure 7 are shown. In these views, the top portion 9 is separated from the bottom support structure 7. The bottom support structure 7 includes holes 40 that are aligned with the drainage holes 30 of the top planar surface 11, so as to provide drainage through both the top portion 9 and the bottom support structure 7.

In some embodiments, the top portion 9 is held to the bottom support structure 7 by an adhesive between the top portion 9 and the bottom support structure 7. In some embodiments, the top portion 9 is held to the bottom support structure 7 by molding the bottom support structure 7 directly within the top portion 9. In some embodiments, the bottom support structure 7 is held to an undersurface of the top portion 7 by features on the undersurface of the top portion 7 such as barbs.

Figure 5:
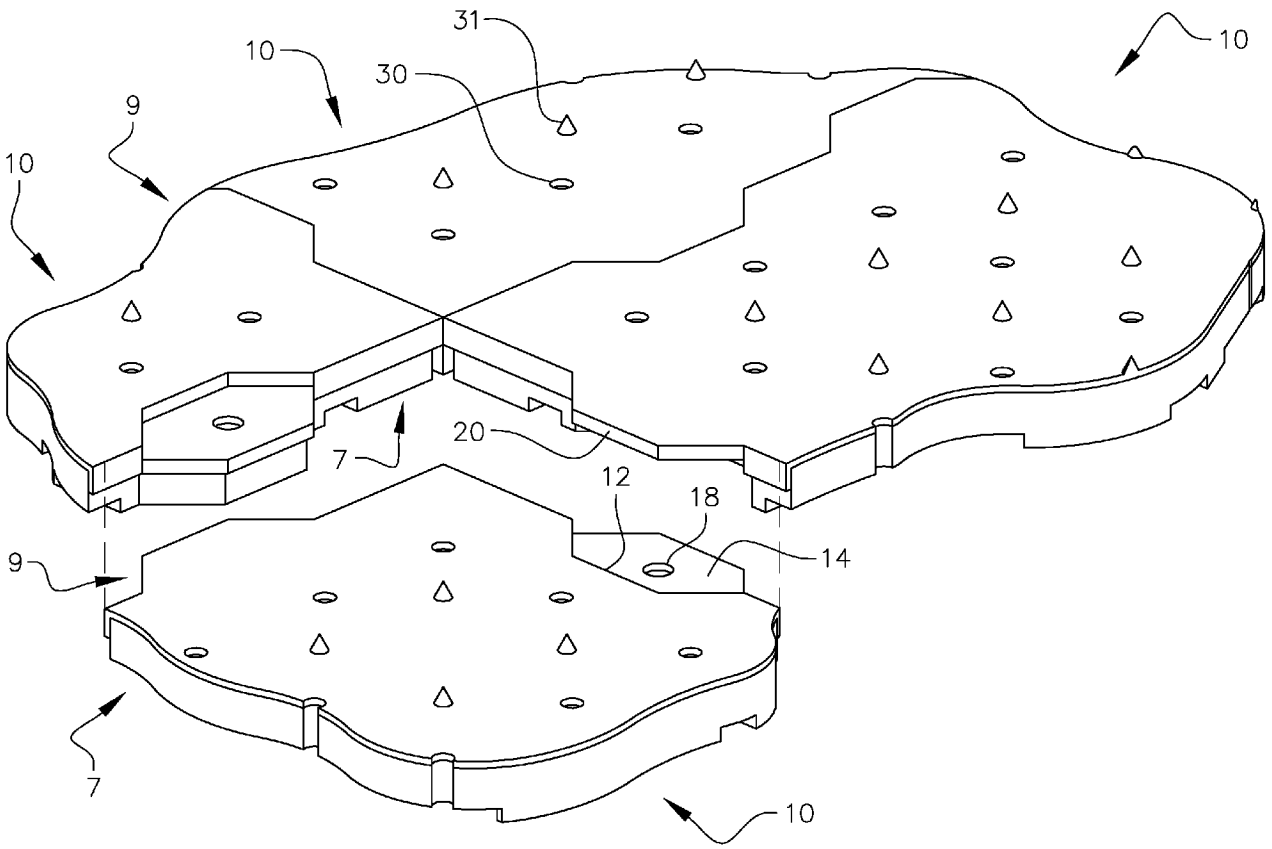
FIG. 5 illustrates a top isometric of a multiple panel assembly.

Referring to FIG. 5, a top isometric view of multiple interlocking panel 10 assemblies is shown. To cover larger areas, multiple interlocking panels 10 are joined along their edges, the upward facing steps 14 and downward facing steps 20 mating and interlocking by way of the downwardly pointing projection 22 on the downward facing steps 20 mating with the mating depressions 18 of the upward facing steps 14, holding the adjacent interlocking panels 10 together.

Figure 6:
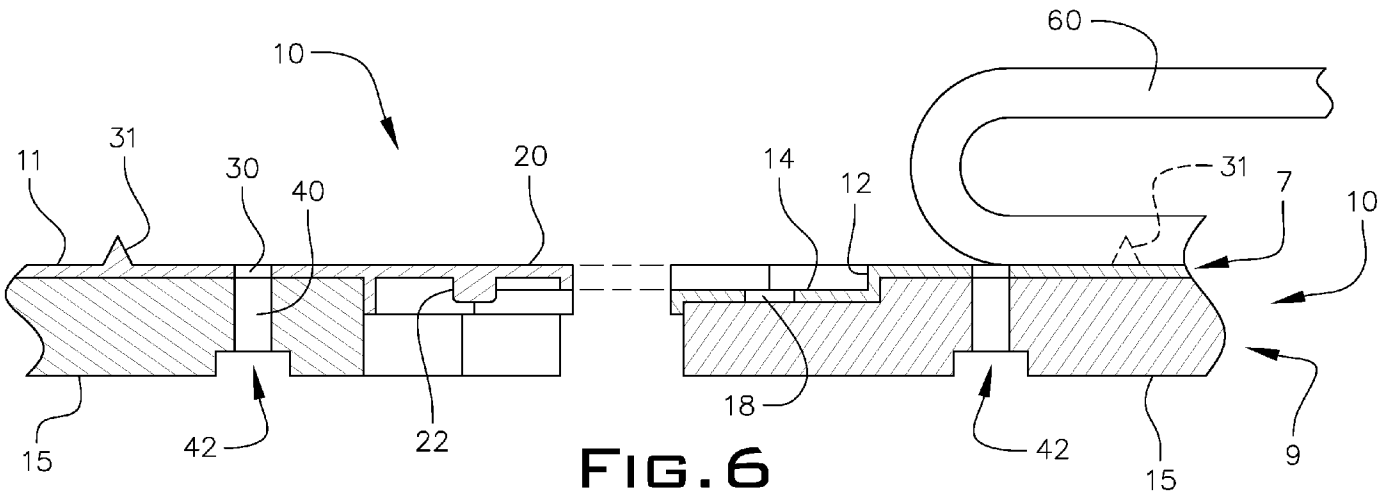
FIG. 6 illustrates a cross section of two panels prior to assembly with cover material rolled back.
Figure 7:
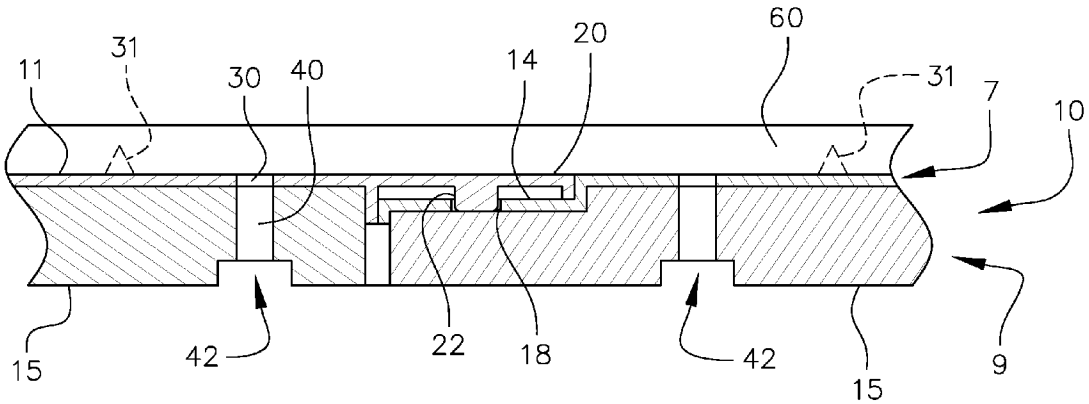
FIG. 7 illustrates a cross section of two panels assembled with cover material.
Figure 8:
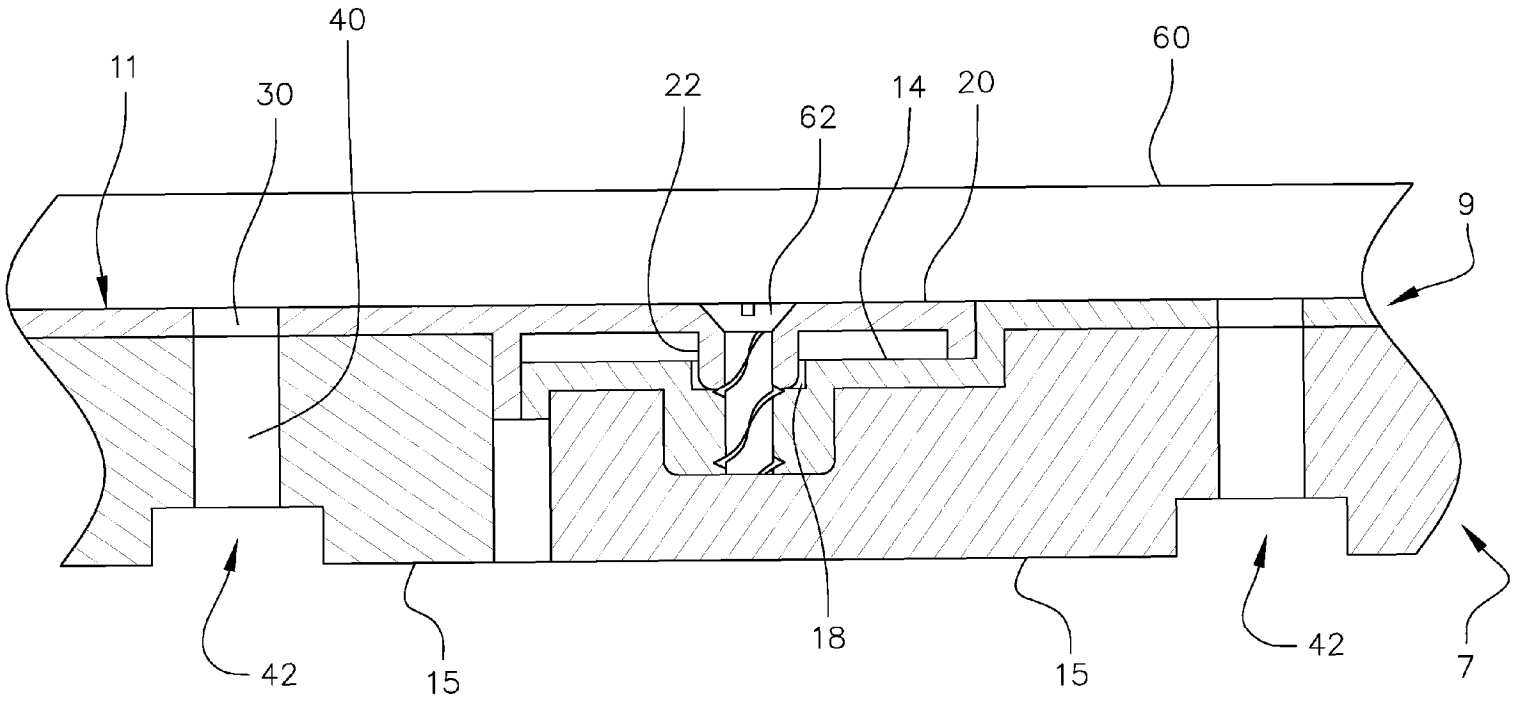
FIG. 8 illustrates a cross section of two panels assembled with cover material and optional fastener.

Referring to FIGS. 6 and 7, cross section views of two interlocking panels 10 are shown prior to assembly with the cover material 60 rolled back in FIG. 6 and assembled with cover material 60 in place in FIG. 7. In FIG. 7, the upward facing step 14 is moving under the downward facing steps 20. In FIG. 8, the upward facing step 14 is under the downward facing steps 20 and held together by the downwardly pointing projection 22 on the downward facing steps 20 mating into the depression 18 of the upward facing steps 14. Any shape of projection 22 and depression 18 is anticipated.

The cover material 60 is any covering material such as carpet, linoleum, vinyl, wood, synthetic wood, ceramic tile, plastic tile, artificial turf, synthetic grass, etc. In embodiments in which the top surface 11 includes projections 31 (e.g. barbs), the projections 31 increase friction between the bottom surface of the cover material 60 and the top planar surface 11, thereby reducing lateral slippage of the cover material 60 as lateral forces are applied to the cover material 60.

Referring to FIG. 8, a cross section of two interlocking panels 10 assembled with cover material 60 and an optional fastener 62. In this embodiment, the upward facing step 14 is mated with the downward facing steps 20 and held together both by the downwardly pointing projection 22 on the downward facing steps 20 mating into the depression 18 of the upward facing steps 14. Additional support and strength is provided from a fastener 62 (shown as a screw). Although the fastener 62 is shown as a screw, any fastener 62 is anticipated including, but not limited to, a pin, a nail, a spike, etc. In FIG. 8, the cover material 60 is in place.

Figure 9:
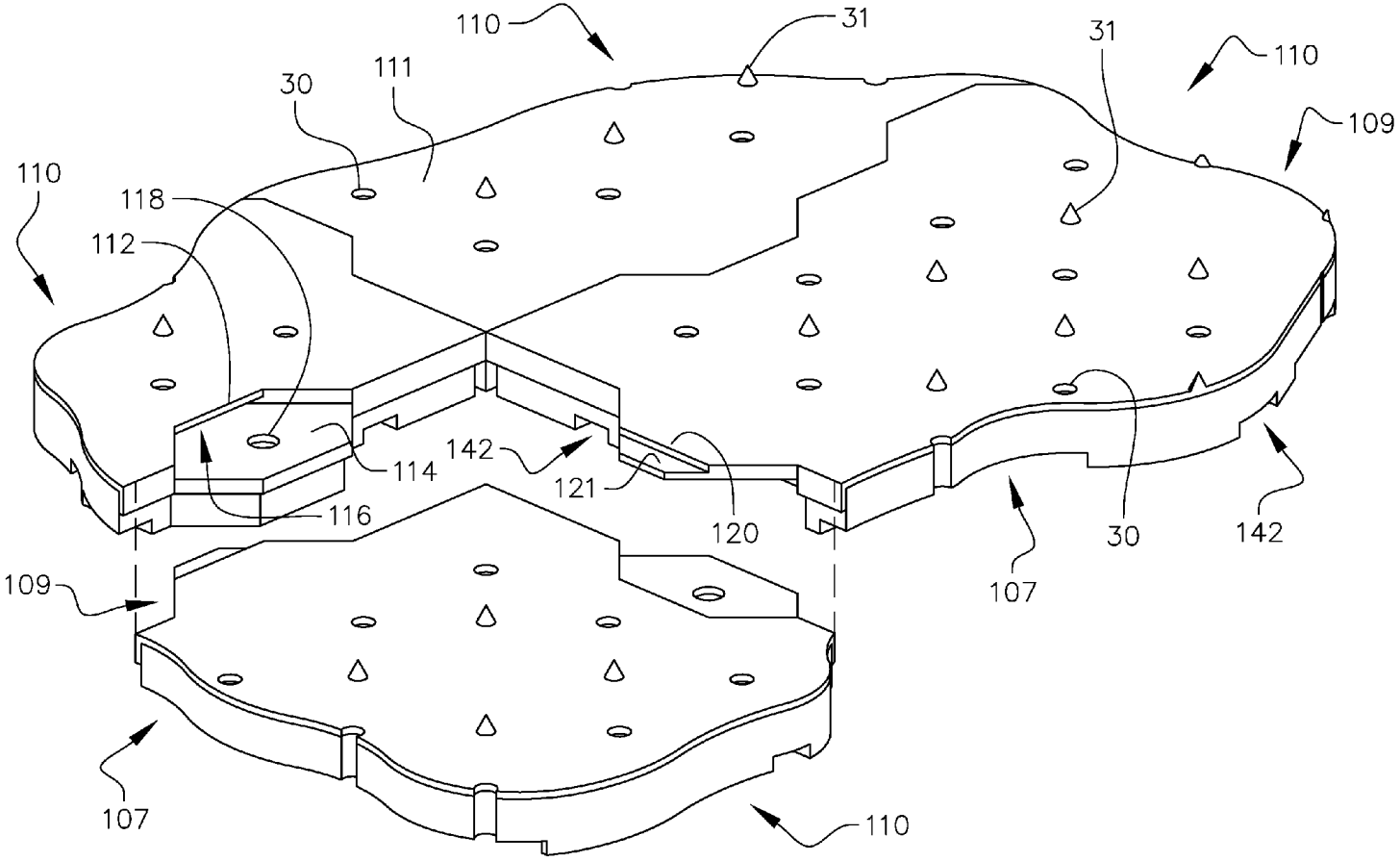
FIG. 9 illustrates a top isometric multiple assembly with male protrusions and female recesses.
Figure 10:
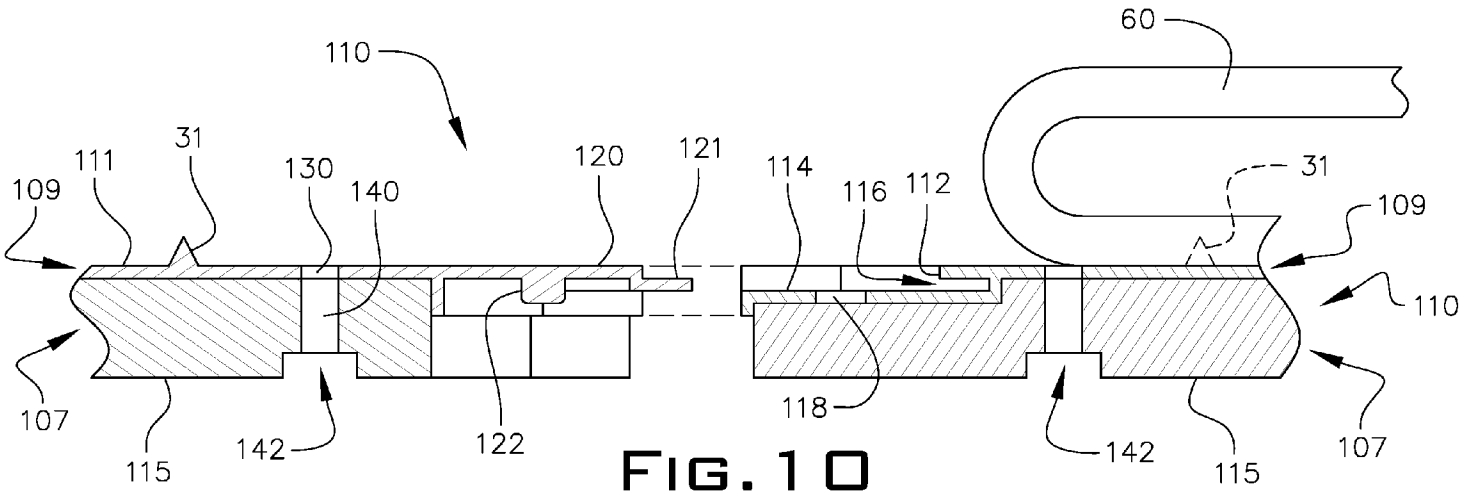
FIG. 10 illustrates a cross section of two panels prior to assembly with cover material rolled back.
Figure 11:
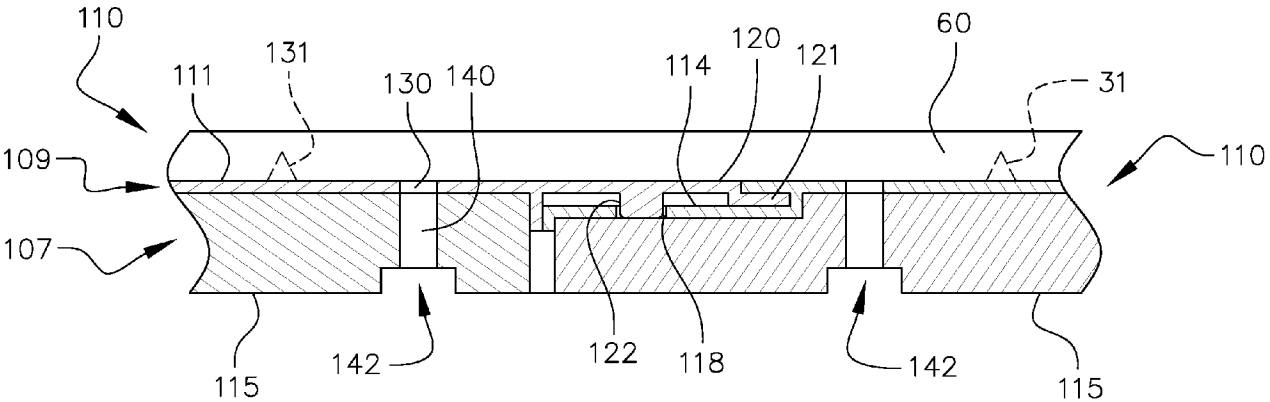
FIG. 11 illustrates a cross section of two panels assembled with cover material.

Referring to FIGS. 9, 10, and 11 multiple assemblies of interlocking panels 110 are shown with a slightly modified interlocking mechanism that includes male protrusions and female recesses. In FIG. 10 a cross section of the multiple assemblies of interlocking panels 110 are shown prior to assembly with the cover material 60 rolled back, while in FIG. 11 a cross section of the two interlocking panels 110 are shown assembled with the cover material 60.

The panel 110 has under hang ledges 121 to allow the downward facing steps 120/121 to be inserted so that the under hang ledge 121 slides into a cavity 116 formed between the upward facing steps 114 and an overhang ledge 112, thereby engaging the projections 122 with depressions 118. The overhang ledge 112 is a continuation of the planar top surface 111 of the panel 110. Such an interlock mechanism helps adjacent interlocking panels 110 retain planar alignment while providing a tight mechanical interlock.

Again, the bottom support structure 107 is made of a shock absorption material that provides support and resiliency to the top surface 111.

In embodiments with interlocking panels 110 that have more than one pair of steps, it is preferred to configure the interlocking panels 110 as shown alternating the upward facing steps 114 with the downward facing steps 120/121. In some embodiments, the downward facing steps 120/121 have projections 122 (e.g. convex projections) and the upward facing steps 114 have mating depressions 118 (e.g. concave dimples). In some embodiments, the downward facing steps 120/121 have depressions 118 and the upward facing steps 114 have mating projections 122. In an alternate embodiment, the upward facing steps 114 are in a different order and do not alternate with the downward facing steps 120/121. In some embodiments, the depressions 118 are larger in cross-sectional size (e.g. diameter) than the projections 122, allowing for lateral movement of panels as the panels expand/contract due to environmental conditions such as heating/cooling.

As with the previous interlocking panels 10, in some embodiments a fastener 62 is included to better hold the interlocking panels 110 together.

It is anticipated that the interlocking panels 110 are disengaged by pulling them apart, overcoming the force of the concave mating dimples 118 and the convex projections 122.

In one embodiment, the top portion 109 of the panel 110 is molded from plastic as an integral rigid body and the bottom support structure 107 is made of a shock absorption material that provides support and resiliency to the planar top surface 111. In some embodiments, the planar top planar surface 111 is coated with a material such as carpet, linoleum, vinyl, wood, synthetic wood, ceramic tile, plastic tile, artificial turf, etc. In some embodiments, the interlocking panels 110 are not covered (e.g. no cover 60) and in some embodiments, an area cover is affixed after the planar interlocking panels 110 are installed and interlocked.

Also, in some embodiments, the top planar surface 111 includes one or more optional projections 31 and/or one or more optional drainage holes 30. The projections 31, such as pointy projections as shown, reduce sideways movement of a covering material 60 such as carpet, linoleum, vinyl, wood, synthetic wood, ceramic tile, plastic tile, artificial turf, synthetic grass, etc. The drainage holes 30 are provided in the top planar surface 111 for drainage. Liquids (e.g. rain, water, etc.) that fall on the top planar surface 111, drain through the drainage holes 30. Some of this liquid percolates down into the sub-surface, while in some embodiments, troughs 142 are formed in the bottom support structure 107. In such, it is preferred that the drainage holes 30 are fluidly interfaced to the troughs 142. As it will be shown, the troughs 142 of one interlocking panel 110 are fluidly interfaced with troughs 142 of adjacent interlocking panels 110, permitting the flow of the fluids between interlocking panels 110.

In FIG. 10, the upward facing step 114 is moving under the downward facing steps 120/121. In this view, the overhang ledge 112 is shown as well as the under hang ledge 121. As the interlocking panels 110 are pushed together as shown in FIG. 11, the under hang ledge 121 snuggly fits between the overhang ledge 112 and the upward facing step 114, holding the interface between adjacent interlocking panels 110 flat together as shown in FIG. 11. In some embodiments, the downward facing steps 120/121 is held within this cavity 116 between the upward facing step 114 and the overhang ledge 112 by the downwardly pointing projection 122 on the downward facing steps 120/121 mating into the mating depression 118 of the upward facing steps 114 or vice versa.

The cover material 60 is any covering material such as carpet, linoleum, vinyl, wood, synthetic wood, ceramic tile, plastic tile, artificial turf, synthetic grass, etc. In embodiments in which the top planar surface 111 includes projections 31 (e.g. barbs), the projections 31 increase friction between the bottom surface of the cover material 60 and the top planar surface 111, thereby reducing lateral slippage of the cover material 60 as lateral forces are applied to the cover material 60. In some embodiments, there is no cover material 60 and the top planar surface 111 provides the walking/playing surface.

Figure 12:
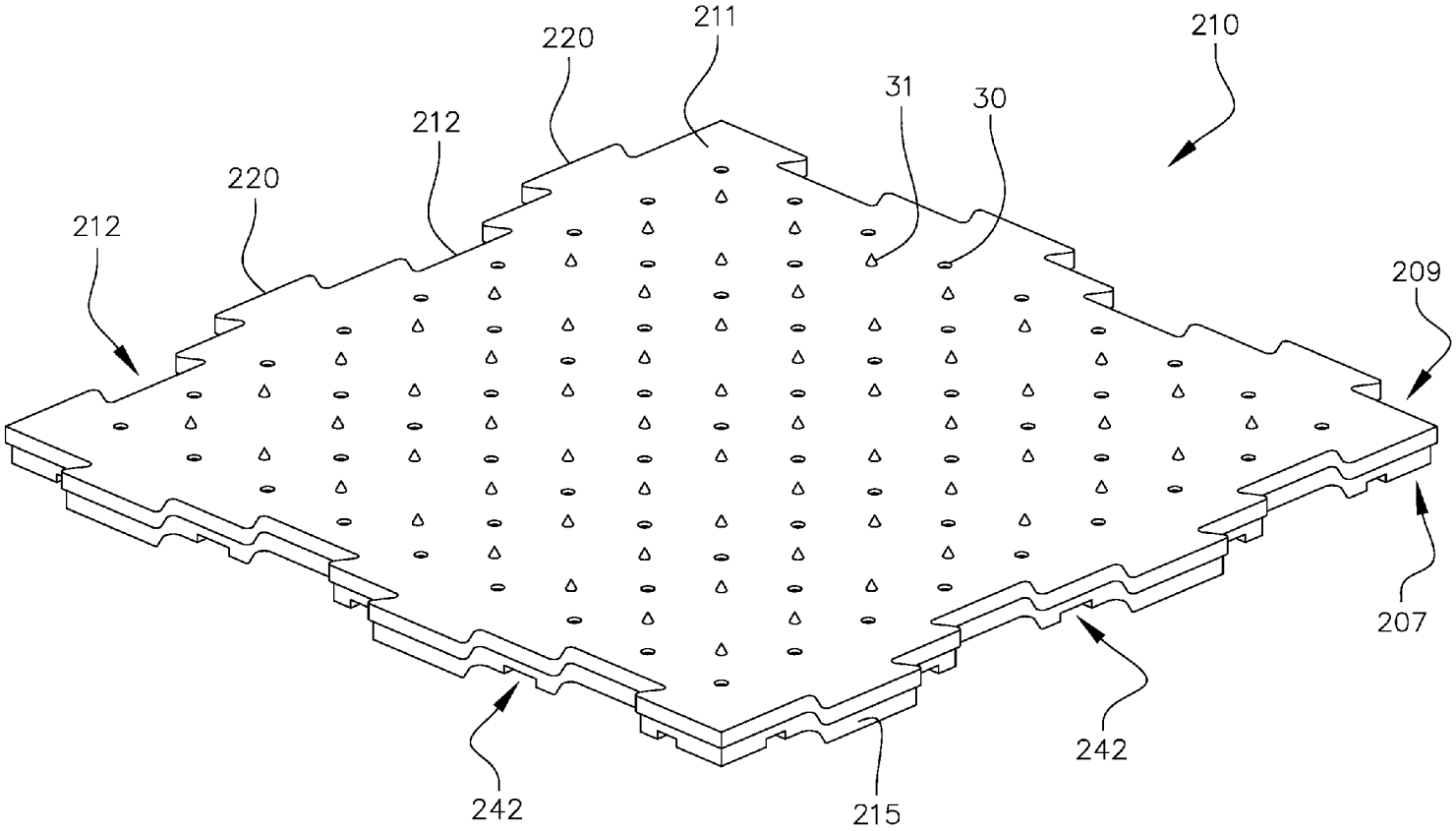
FIG. 12 illustrates a top isometric assembled top planar surface and the bottom support structure (dovetail design).
Figure 13:
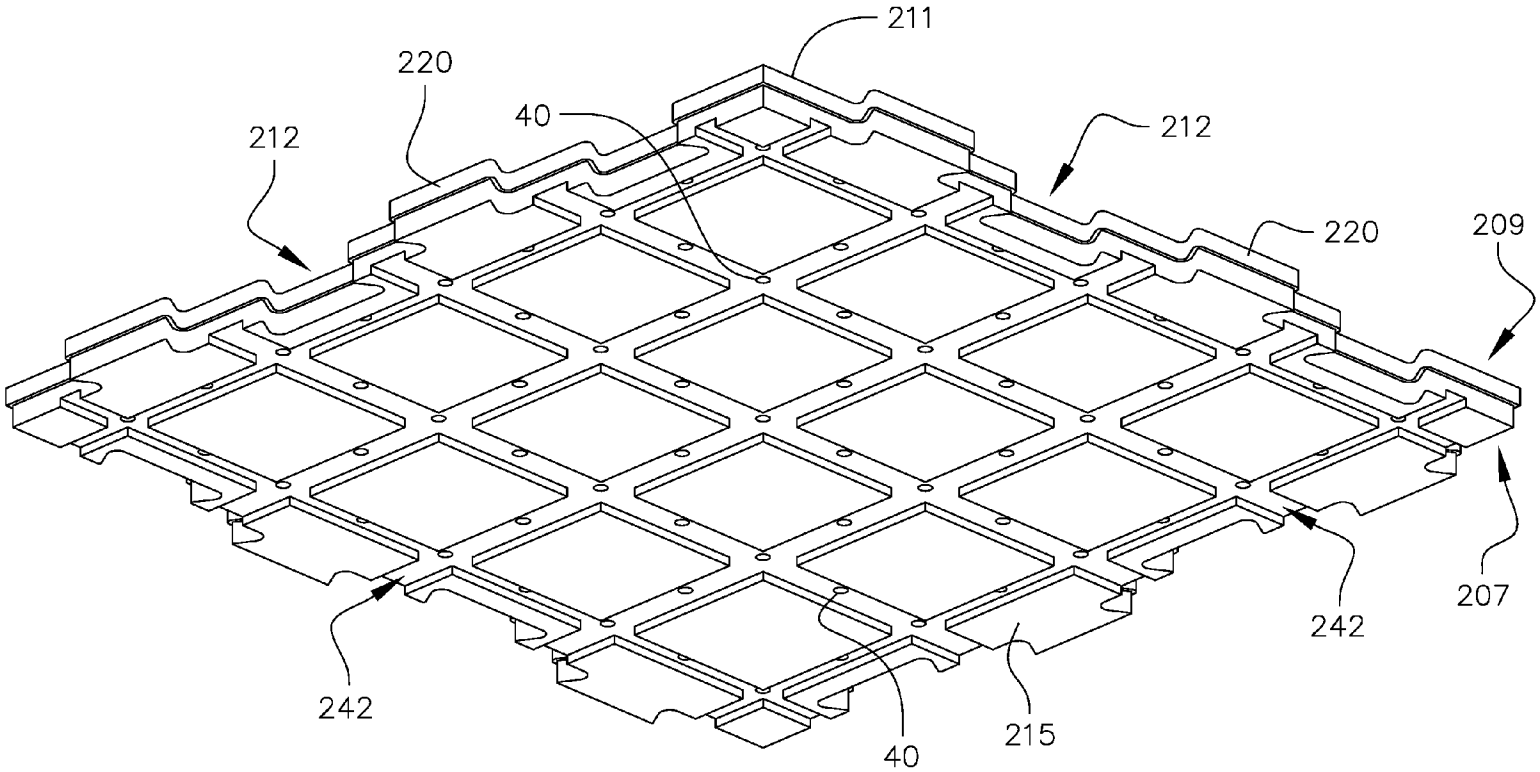
FIG. 13 illustrates a bottom isometric assembled top planar surface and the bottom support structure (dovetail design).
Figure 14:
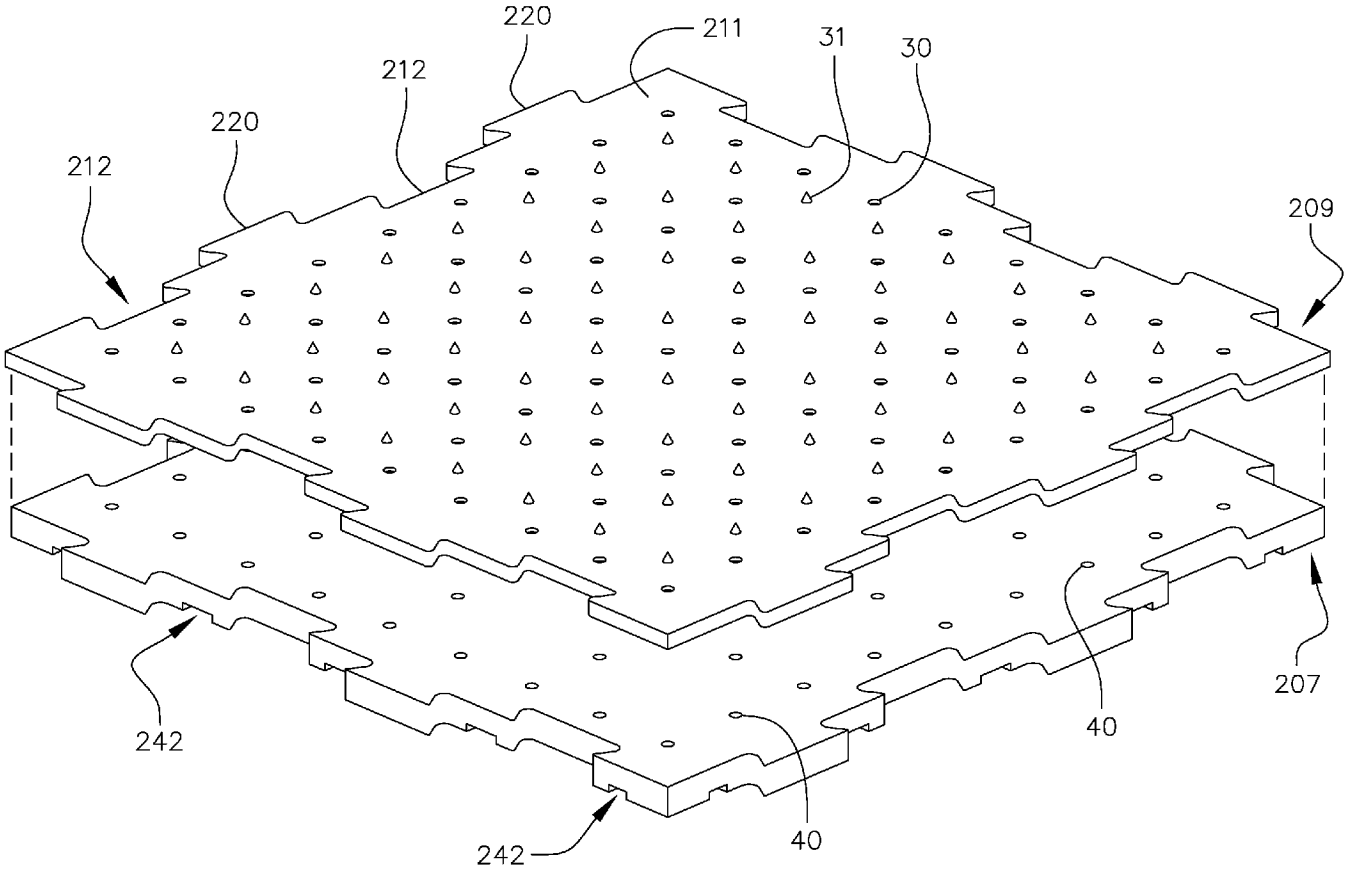
FIG. 14 illustrates a top isometric exploded top planar surface and the bottom support structure (dovetail design).
Figure 15:
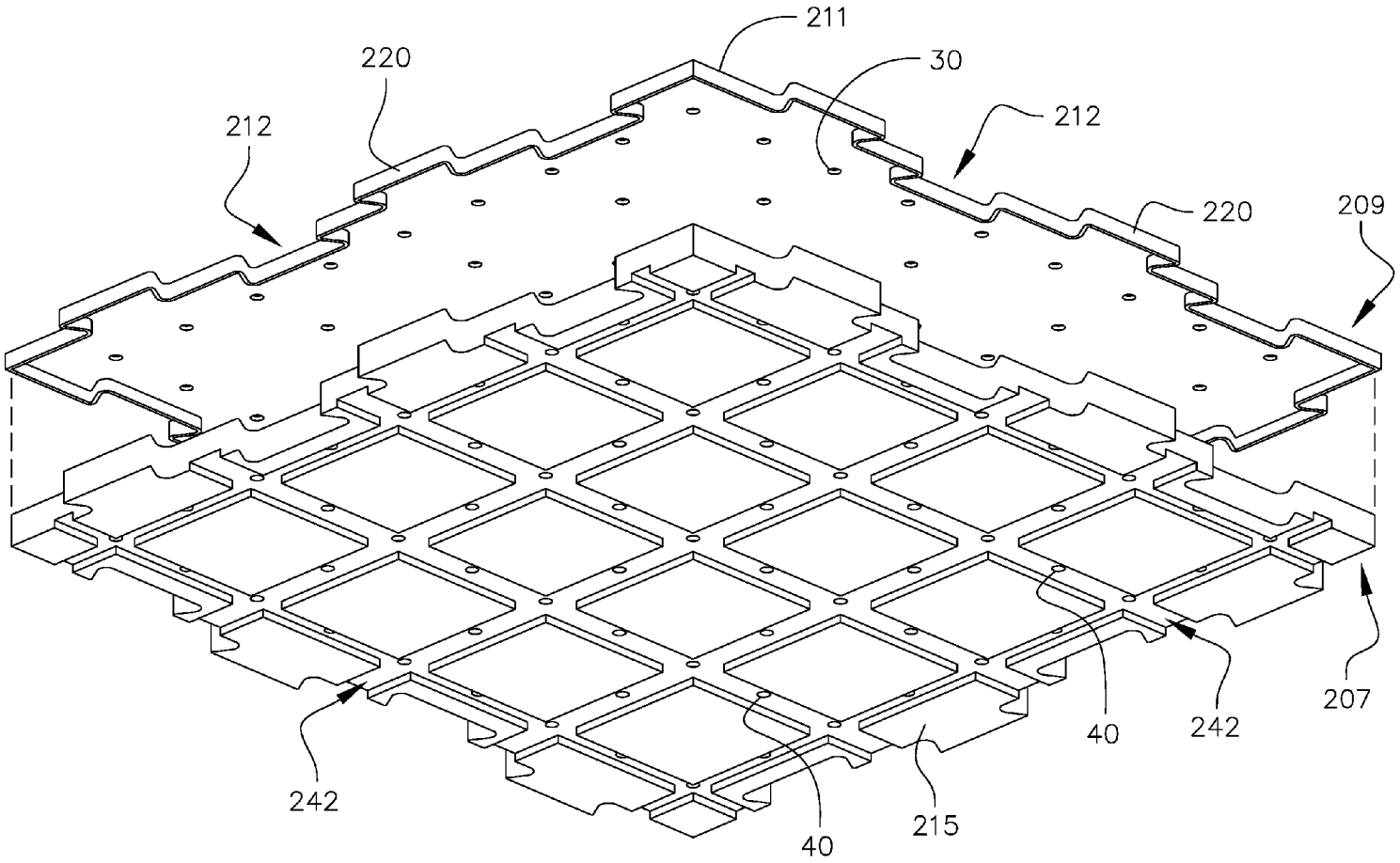
FIG. 15 illustrates a bottom isometric exploded top planar surface and the bottom support structure (dovetail design).

Referring to FIGS. 12-15, views of another interlocking panel 210 having keyed (dovetail design) attachment mechanism is shown. In FIG. 12, a top isometric of the interlocking panel 210 is shown with the top portion 209 assembled to the bottom support structure 207. In FIG. 13, a bottom isometric of the assembled interlocking panel 210 is shown. In FIG. 14, a top isometric exploded view of the interlocking panel 210 is shown with the top portion 209 and the bottom support structure 207 separated. In FIG. 15, a bottom isometric exploded view of the interlocking panel 210 is shown with the top portion 209 and the bottom support structure 207 separated.

In some embodiments, the top portion 209 (includes top planar surface 211, side walls, and keyed interlocking features 212/214/218/220) is molded from a plastic or rubber material, and/or formed/stamped from a metal, providing the rigid or semi-rigid top surface 211. Any suitable material(s) is anticipated such as plastic, filled plastic, phenolic, stiff rubber, aluminum, etc.

Supporting the planar top surface 211 is a bottom support structure 207 bonded or held thereto. The bottom support structure 207 is made of a shock absorption material that provides support and resiliency to the top surface 211. Although any resilient shock absorption material is anticipated, in some embodiments, the shock absorption material is polypropylene foam, expanded polypropylene foam, polyethylene foam, polystyrene foam, urethane foam and/or rubber such as processed recycled rubber.

In some embodiments, the planar top surface 211 includes projections 31 such as pointy projections as shown for reducing sideways movement of a covering material 60 such as artificial turf, carpet, etc.

In some embodiments, one or more drainage holes 30 are provided in the top surface 211 for drainage. Liquids (e.g. rain, water, etc.) that fall on the surface 211, drain through the drainage holes 30. Some of this liquid percolates down into the sub-surface, while in some embodiments, troughs 242 are formed in the bottom support structure 215. In such, it is preferred that the drainage holes 30 are fluidly interfaced to the troughs 242. As it will be shown, the troughs 242 of one interlocking panel 210 are fluidly interfaced with troughs 242 of adjacent interlocking panels 210, permitting the flow of the fluids between interlocking panels 210.

Although many panel interlock mechanisms are anticipated, the interlock mechanism of FIGS. 12-15 includes keyed projections 220 and keyed projection receivers 212. The keyed projections 220 are located so they align with and interface into keyed projection receivers 212 of adjacent interlocking panels 210. In some embodiments, the keyed projection receivers 212 are larger than the keyed projections 220, allowing for lateral movement of panels as the panels expand/contract due to environmental conditions such as heating/cooling.

Referring to FIGS. 14 and 15, top and bottom isometric exploded views of the top planar surface 211 and the bottom support structure 215 are shown. In these views, the top portion 209 is separated from the bottom support structure 207. The bottom support structure 207 includes holes 40 that are aligned with the drainage holes 30 of the top planar surface 211, so as to provide drainage through both the top portion 209 and the bottom support structure 207.

In some embodiments, the panels are manufactured with an adhesive between the top portion 209 and the bottom support structure 207. In some embodiments, the panels are manufactured by molding the bottom support structure 207 directly within the bottom area of the top portion 209. In some embodiments, the bottom support structure 207 is held to an undersurface of the top portion 207 by features on the undersurface of the top portion 207 such as barbs.

Figure 16:
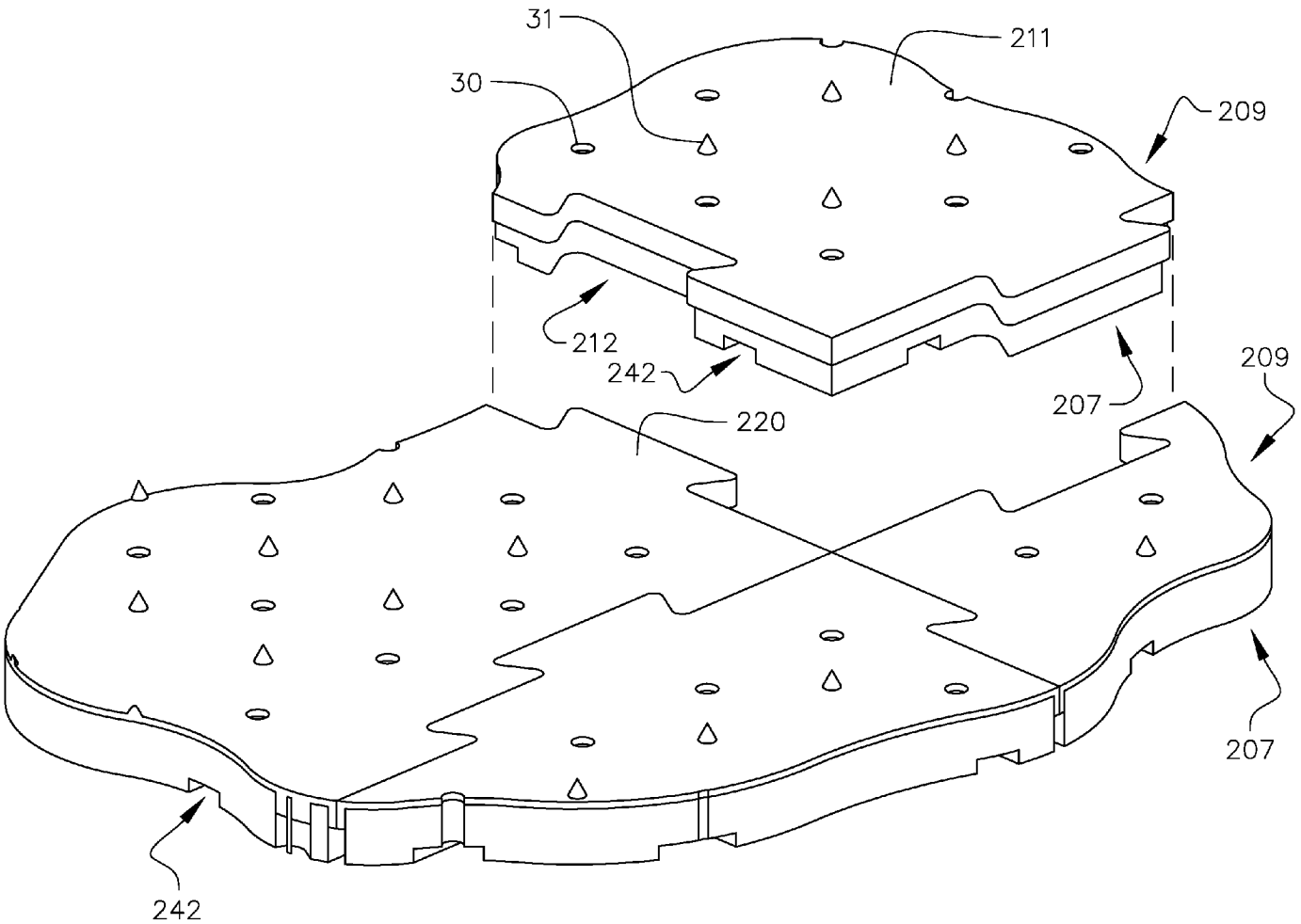
FIG. 16 illustrates a top isometric multiple panel assembly (dovetail design).

Referring to FIG. 16, a top isometric showing multiple interlocking panels 210 assembled using the keyed projections 220 and keyed projection receivers 212. In this, the multiple interlocking panels 210 are assembled by aligning the keyed projections 220 of one interlocking panel 210 with keyed projection receivers 212 of an adjacent interlocking panel 210 and pressing the keyed projections 220 into the keyed projection receivers 212, similar to a jigsaw puzzle.

As these interlocking panels 210 are often used to form a walking surface, it is anticipated that a force of greater weight will often be asserted on one interlocking panel 210 than on an adjacent interlocking panel 210 (e.g. a person steps on one interlocking panel 210, but not the adjacent interlocking panel 210). To limit skewing of the interlocking panels 210, in some embodiments, a panel locking mechanism 250/252 as shown in FIGS. 17 and 18 is employed.

It is also anticipated that in some embodiments, the keyed projection receivers 212 are larger than the keyed projections 220, allowing for lateral movement of panels as the panels expand/contract due to environmental conditions such as heating/cooling.

Figure 18:
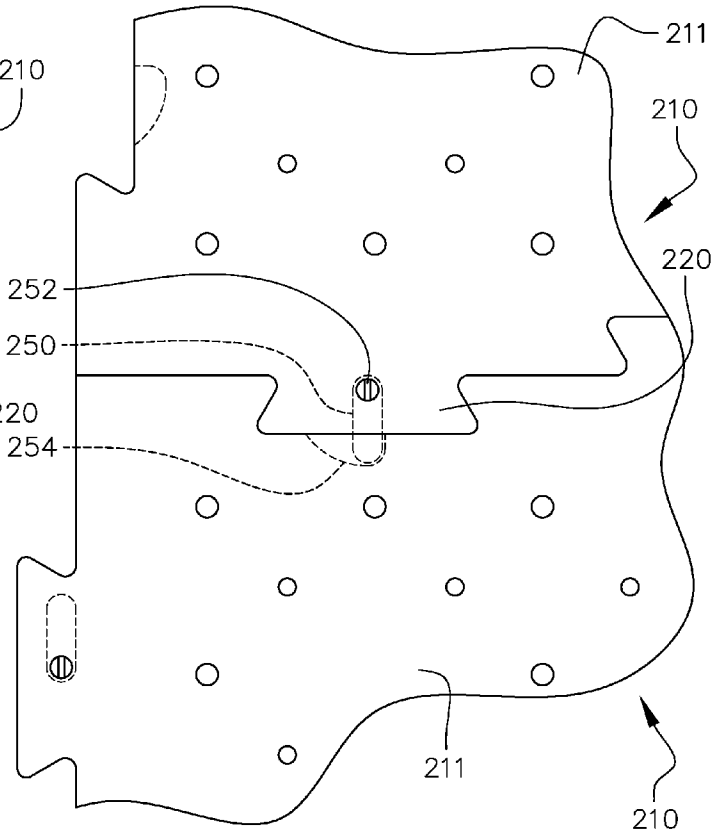
FIG. 18 illustrates a top view with optional locked fastener (twist lock example).
Figure 17:
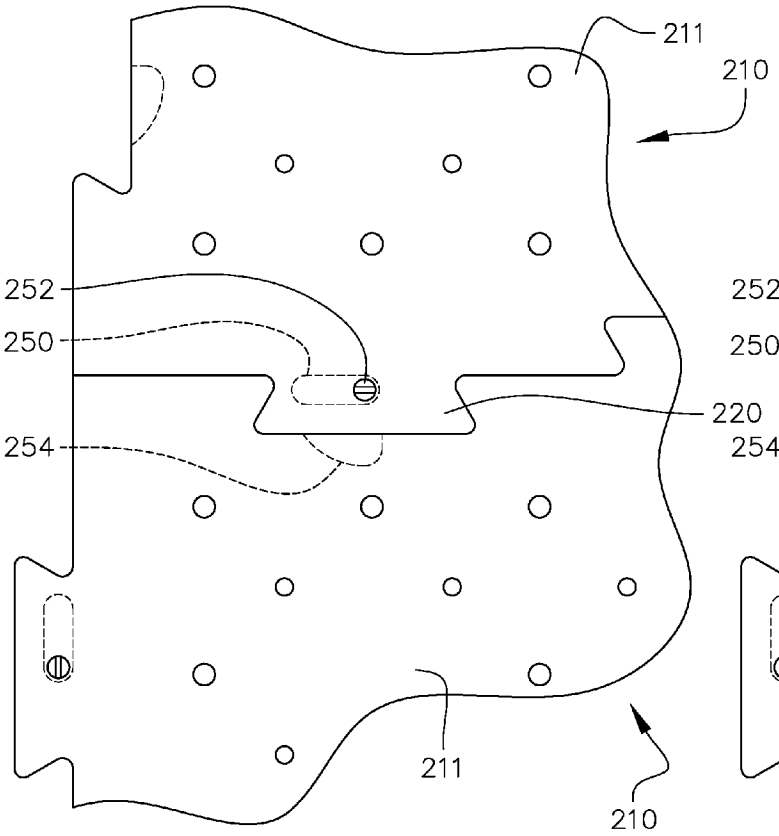
FIG. 17 illustrates a top view with optional unlocked fastener (twist lock example).

Referring to FIGS. 17 and 18, a top view of two adjacent interlocking panels 210 is shown with a panel locking mechanism 250/252/254. In FIG. 17, the panel locking mechanism 250/252/254 is disengaged. In FIG. 18, the panel locking mechanism 250/252/254 is engaged. The panel locking mechanism 250/252/254 includes a locking arm 250 that is engaged/disengaged by turning the actuation head 252 (e.g. a head that receives a screwdriver, hex driver, square driver, etc.). When engaging, the locking arm 250 (e.g. in the keyed projections 220) moves into a slot 254 (e.g. in the keyed projection receivers 212) of an adjacent interlocking panel 210. Note that in some embodiments, the panel locking mechanism 250/252/254 is located in the keyed projection receivers 212 and the slot 254 is located in the keyed projections 220. It is also anticipated that the locking mechanism 250/252/254 be on any side surface of the interlocking panel 210 that contacts with an adjacent interlocking panel 210.

Figure 19:
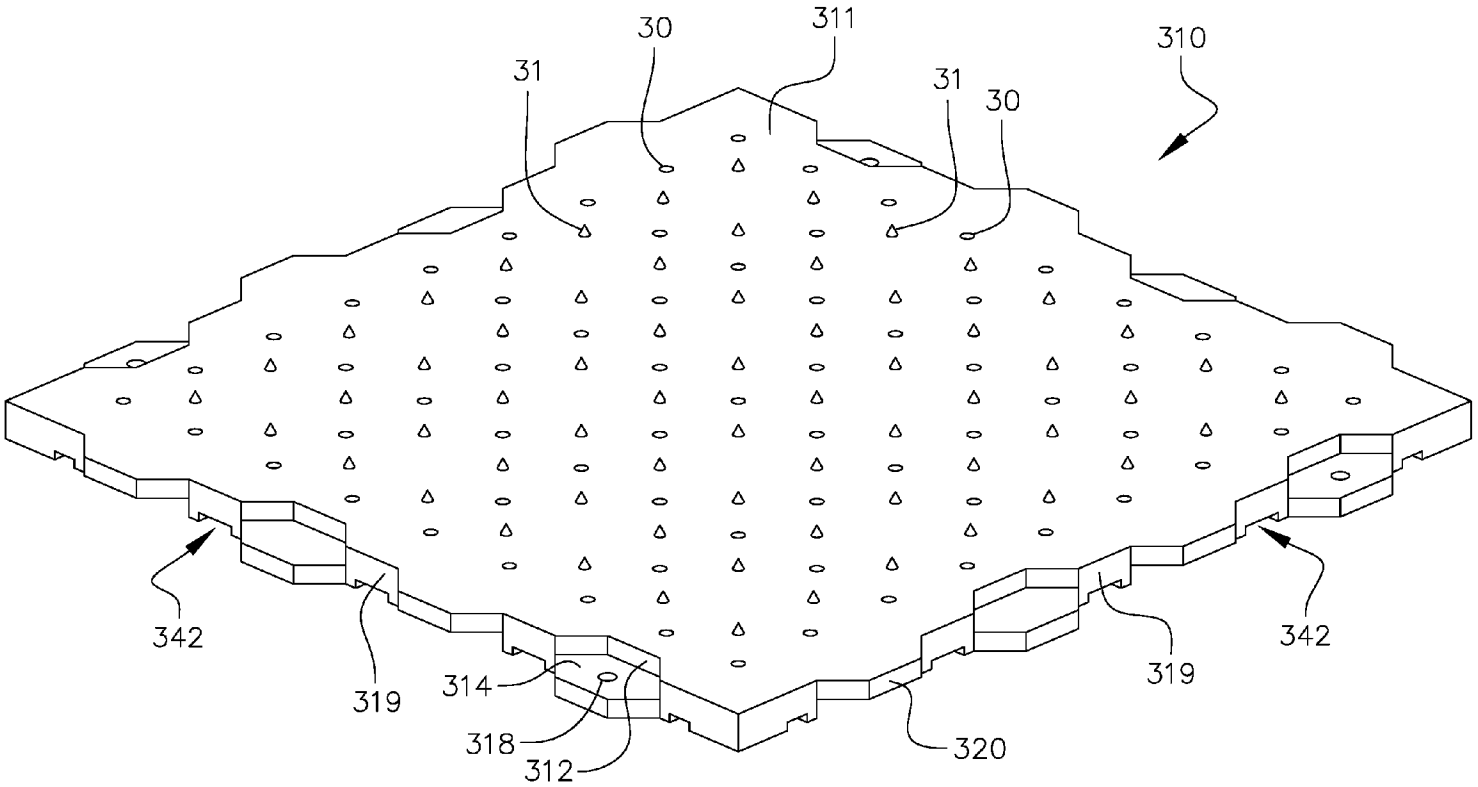
FIG. 19 illustrates a top isometric of a top planar surface and the bottom support structure of an encapsulated panel.
Figure 20:
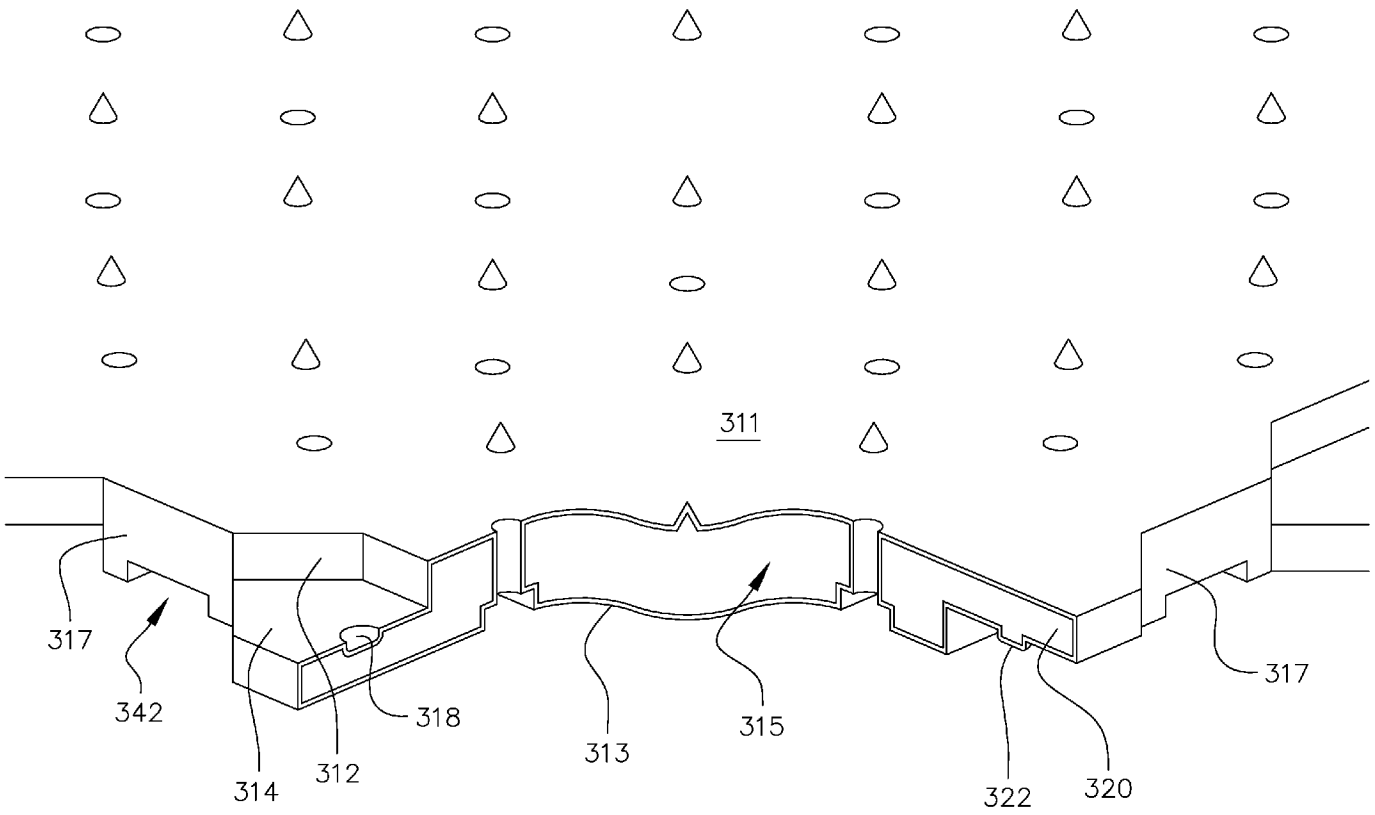
FIG. 20 illustrates a top isometric of a top planar surface and the bottom support structure of an encapsulated panel, shown close up with cut away to show shock absorption inside.

Referring to FIGS. 19 and 20, an interlocking panel 310 is shown. In FIG. 19, a top isometric of a top planar surface 310 is shown. In FIG. 20, the top planar surface 310 is shown close up with cut away to show inner shock absorption material 315. In this embodiment, the shock absorption core 315 is encapsulated by a plastic outer shell 311/313/317 having a substantially planar top surface 311, a bottom surface 313, and side surfaces 317. Although shown with a specific inter-panel locking system that has upwardly facing steps 314/312 having depressions 318 (e.g. concave dimples) and downwardly facing steps 320 having projections 322, any of the prior described inter-panel locking systems are equally anticipated. It is also anticipated that in some embodiments, the depressions 318 are larger in cross-sectional size (e.g. diameter) than the projections 322, allowing for lateral movement of panels as the panels expand/contract due to environmental conditions such as heating/cooling.

In some embodiments, drainage holes 30 are drilled/formed, passing through the plastic outer shell 311/313 and through the shock absorption core 315 such that liquids are free to pass from the planar upper surface 311, through the drainage holes 30 to the bottom surface of the interlocking panel 310. In some embodiments, troughs 342 are formed in the bottom surface 313 permitting flow of such fluids. It is preferred that such troughs 342 from one interlocking panel 310 fluidly interfaces with a trough 342 from an adjacent interlocking panel 310, enabling flow of such fluids between interlocking panels 310.

In some embodiments, the planar top surface 311 includes projections 31 (as discussed previously) such as pointy projections as shown for reducing sideways movement of a covering material 60 such as artificial turf, carpet, etc.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes. For example, throughout the description, the convex projection is located on the bottom of the downward facing step and the concave dimple is located on the top of the upward facing step, but the present invention works equally as well with the convex projection located on the top of the upward facing step and the concave dimple on the bottom of the downward facing step.

What is claimed is:

1. An interlocking panel for a floor system base, the interlocking panel comprising:

a top portion having a substantially planar top surface and side surfaces, the side surfaces depending downward from the planar top surface forming a cavity in an underside of the substantially planar top surface, the top portion having means for interlocking on at least one of the side surfaces;

a bottom support structure, the bottom support structure filling the cavity, thereby providing support and shock absorption to the substantially planar top surface.

2. The interlocking panel of claim 1, further comprising a bottom surface interfaced to the side surfaces, thereby encapsulating the bottom support structure.

3. The interlocking panel of claim 1, wherein the means for interlocking comprises:

a downward facing step formed at one of the side surfaces of the top portion; and an upward facing step formed at one of the side surfaces of the top portion;

whereas the downward facing step of a first interlocking panel interlocks to complementary upward facing step of a second interlocking panel.

4. The interlocking panel of claim 3, wherein the downward facing step includes at least one projection and the upward facing step includes a corresponding at least one dimple and the first interlocking panel is held together with the second interlocking panel by the projections mating with the dimples.

5. The interlocking panel of claim 4, wherein each of the at least one projection has a smaller cross-sectional size than the corresponding at least one dimple, for allowing lateral movement of the interlocking panels and providing an expansion joint.

6. The interlocking panel of claim 3, wherein the means for interlocking further comprises:

an overhang ledge formed over the downward facing step, thereby forming a cavity; and an under hang ledge formed in a top surface of the upward facing step allowing the upward facing step of the first interlocking panel to fit within the cavity of the second interlocking panel for maintaining linearity of connected interlocking panels.

7. The interlocking panel of claim 6, wherein the downward facing step includes a projection and the upward facing step includes a corresponding depression and the first interlocking panel is held together with the second interlocking panel by the projection mating with the depression.

8. The interlocking panel of claim 7, wherein the projection has a smaller cross-sectional size than the depression, allowing lateral movement of the interlocking panels and providing an expansion joint.

9. The interlocking panel of claim 1, wherein the substantially planar top surface is covered with a material selected from the group consisting of carpet, linoleum, vinyl, wood, synthetic wood, ceramic tile, plastic tile and artificial turf.

10. The interlocking panel of claim 1, wherein the means for interlocking comprises:

a keyed projection formed at the side surface of the top portion; and a keyed projection receiver formed at the side surface of the top portion;

whereas the keyed projection of a first interlocking panel interlocks to a complementary keyed projection receiver of a second interlocking panel.

11. The interlocking panel of claim 10, wherein a locking mechanism is provided including a locking arm connected to an actuation head in the first interlocking panel that is engaged/disengaged with a slot in the second interlocking panel by turning the actuation head.

12. An interlocking panel for a floor system base, the interlocking panel comprising:

a top portion having a substantially planar top surface and side surfaces depending downwardly from edges of the substantially planar top surface forming a cavity beneath the substantially planar top surface, the top portion having means for interlocking on at least one of the side surfaces;

a bottom support structure comprised of a shock absorption material, the bottom support structure held within the cavity for providing support and shock absorption to the substantially planar top surface.

13. The interlocking panel of claim 12, wherein the shock absorption material is made from one or more materials selected from the group consisting of polypropylene foam, expanded polypropylene foam, polyethylene foam, polystyrene foam, urethane foam, rubber, and processed recycled rubber.

14. The interlocking panel of claim 12, wherein the top portion is made of one or more material is selected from the group consisting of polypropylene, structural urethane foams, polyolefin, filled plastic, phenolic, stiff rubber, and aluminum.

15. The interlocking panel of claim 12, wherein the means for interlocking comprises:

a downward facing step formed at one of the side surfaces of the top portion; and an upward facing step formed at one of the side surfaces of the top portion;

whereas the downward facing step of a first interlocking panel interlocks to complementary upward facing step of a second interlocking panel.

16. The interlocking panel of claim 15, wherein the downward facing step includes at least one projection and the upward facing step includes a corresponding at least one dimple and the first interlocking panel is held together with the second interlocking panel by the projections mating with the dimples.

17. The interlocking panel of claim 16, wherein each of the at least one projection has a smaller cross-sectional size than the corresponding dimple, for allowing lateral movement of the interlocking panels and providing an expansion joint.

18. The interlocking panel of claim 12, wherein the substantially planar top surface is covered with a material selected from the group consisting of carpet, linoleum, vinyl, wood, synthetic wood, ceramic tile, plastic tile, and artificial turf.

19. An interlocking panel for a floor system base, the interlocking panel comprising:

a top portion made from one or more materials selected from the group consisting of polypropylene, structural urethane foams, polyolefin, filled plastic, phenolic, stiff rubber, and aluminum; the top portion having a substantially planar top surface and having side surfaces depending downwardly from edges of the substantially planar top surface forming a cavity beneath the substantially planar top surface, the top portion having means for interlocking situated on at least one of the side surfaces;

a bottom support structure comprised of one or more shock absorption material(s) selected from the group consisting of polypropylene foam, expanded polypropylene foam, polyethylene foam, expanded polyethylene foam, polystyrene foam, expanded polystyrene foam, urethane foam, rubber, and processed recycled rubber, the bottom support structure held within the cavity for providing support and shock absorption to the substantially planar top surface.

20. The interlocking panel of claim 19, wherein the means for interlocking comprises:

a downward facing step formed at one of the side surfaces of the top portion; and an upward facing step formed at one of the side surfaces of the top portion;

whereas the downward facing step of a first interlocking panel interlocks to complementary upward facing step of a second interlocking panel.

* * * * *